US008807244B2

(12) United States Patent
Neidhardt

(10) Patent No.: US 8,807,244 B2
(45) Date of Patent: Aug. 19, 2014

(54) METHOD AND APPARATUS FOR STRENGTHENING A WELLBORE

(75) Inventor: Dietmar J. Neidhardt, The Woodlands, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 328 days.

(21) Appl. No.: 13/399,722

(22) Filed: Feb. 17, 2012

(65) Prior Publication Data

US 2012/0211279 A1 Aug. 23, 2012

Related U.S. Application Data

(60) Provisional application No. 61/444,691, filed on Feb. 18, 2011.

(51) Int. Cl.

| | |
|---|---|
| ***E21B 7/00*** | (2006.01) |
| ***E21B 21/00*** | (2006.01) |
| ***E21B 7/20*** | (2006.01) |
| ***E21B 33/138*** | (2006.01) |

(52) U.S. Cl.

CPC ..... *E21B 21/003* (2013.01); *E21B 7/20* (2013.01); *E21B 33/138* (2013.01)

USPC ..... 175/72

(58) Field of Classification Search

USPC ..... 175/72; 166/291, 292

See application file for complete search history.

(56) References Cited

U.S. PATENT DOCUMENTS

| | | | | |
|---|---|---|---|---|
| 2,166,937 | A | 7/1939 | Bettis | |
| 2,495,073 | A | 1/1950 | Morris | |
| 2,776,111 | A | 1/1957 | Vance | |
| 7,431,106 | B2 * | 10/2008 | Alberty et al. | 175/72 |
| 2004/0045741 | A1 | 3/2004 | Tessari et al. | |
| 2006/0113113 | A1 | 6/2006 | Underwood et al. | |
| 2009/0221452 | A1 | 9/2009 | Whitfill et al. | |
| 2010/0250204 | A1 | 9/2010 | Leonard et al. | |

FOREIGN PATENT DOCUMENTS

| | | |
|---|---|---|
| GB | 2396365 | 6/2004 |
| GB | 2418212 | 3/2006 |
| WO | 2009018536 | 2/2009 |
| WO | 2009080358 | 7/2009 |

OTHER PUBLICATIONS

International Preliminary Report on Patentability issued in corresponding International Application No. PCT/US2012/025703; Dated Aug. 21, 2013 (7 pages).

"Particle Size Distribution Improves Casing-While-Drilling Wellbore-Strengthening Results", R. Watts et al., Proceedings of IADC/SPE Drilling Conference and Exhibition, IADC/SPE 128913; Feb. 2, 2010, XP055066094 pp. 1-11 (11 pages).

* cited by examiner

*Primary Examiner* — William P Neuder

(74) *Attorney, Agent, or Firm* — Osha Liang LLP

(57) ABSTRACT

Embodiments include drilling through a formation using a drill bit conveyed by a tubular string having an outer diameter at least 70 percent of the wellbore being drilled. The formation is drilled at a first rate of penetration (ROP) while pumping drilling fluid at a first flow rate. After drilling through the formation, the ROP is reduced to a second ROP, the flow rate is reduced to a second flow rate, and pressure is increased in the wellbore until drilling fluid begins to leak into the formation. While maintaining the increased pressure in the wellbore, the volume of drilling fluid lost to the formation is monitored until the rate at which the drilling fluid loss occurs is reduced. Components of this procedure are repeated until a selected wellbore strength is achieved.

12 Claims, 1 Drawing Sheet

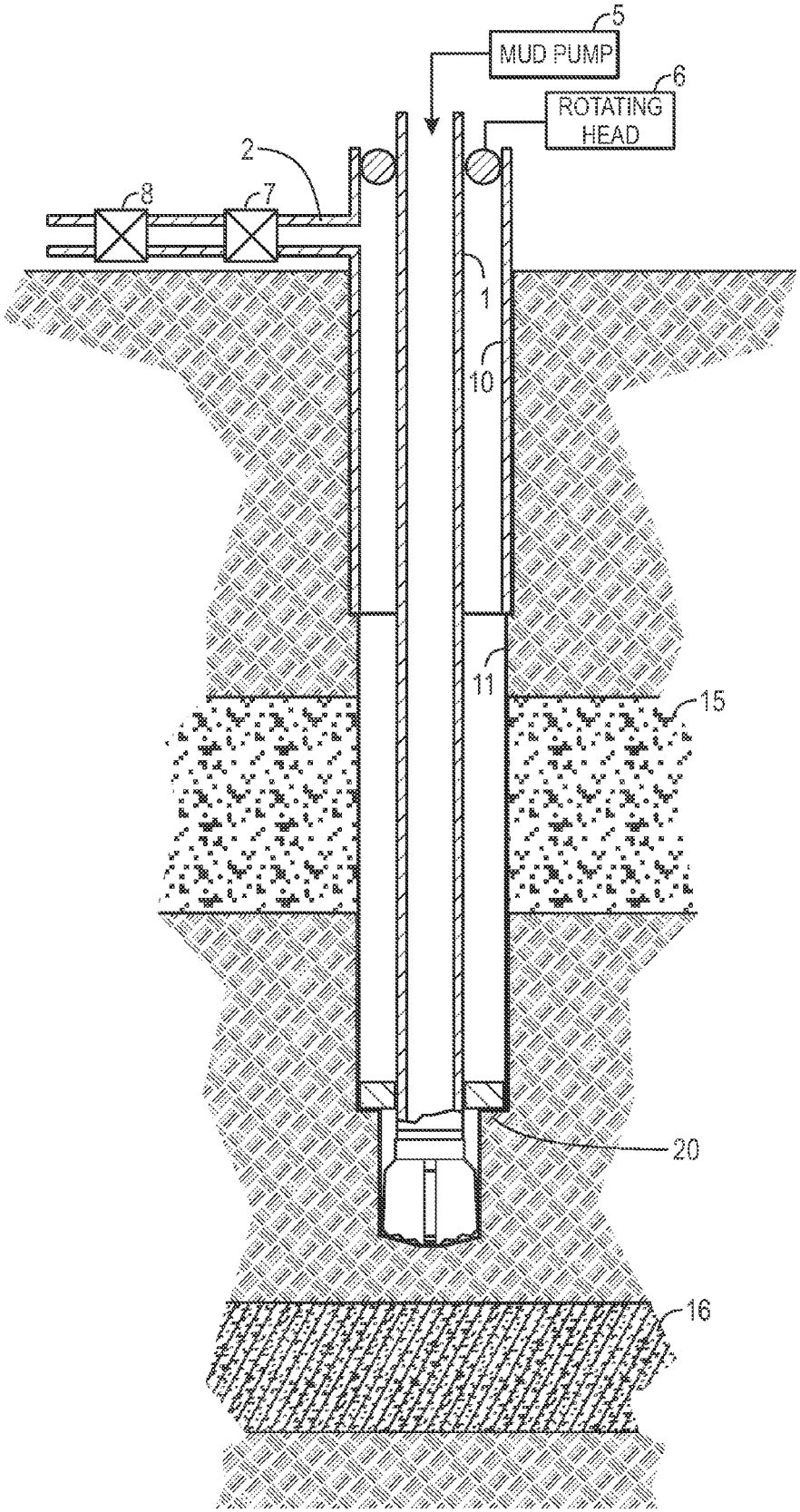
5
MUD PUMP
6
ROTATING HEAD
2
8
7
1
10
11
15
20
16

METHOD AND APPARATUS FOR STRENGTHENING A WELLBORE

CROSS-REFERENCE TO RELATED APPLICATION

This application claims priority from U.S. Provisional Patent Application Ser. No. 61/444,691, entitled "Method and Apparatus for Strengthening a Wellbore," filed Feb. 18, 2011, which is incorporated herein by reference in its entirety.

BACKGROUND OF THE INVENTION

Drilling with casing or liners instead of conventional drill pipe has been shown to increase the strength of a wellbore as measured by the difference in weight of the drilling fluid ("mud") that can be circulated through a given formation during drilling of the formation and after continued drilling past the formation without losing mud to the formation ("lost circulation"). For example, wells drilled using casing in Piceance Basin in Colorado found improvements of more than 3 pounds per gallon (ppg) in formations that were initially experiencing lost circulation when drilling the particular formation. This experience was discussed in detail in a paper written by R. Watts, et al. and published in 2010 by the International Association of Drilling Contractors and Society of Petroleum Engineers as IADC/SPE 128913 ("the '913 paper").

The exact mechanism for the wellbore strengthening that occurs while drilling with casing is not completely known, but is understood to result from the casing (or liner) smearing cuttings and other drilling fluid solids into small fractures in the wellbore as the casing and centralizers rotate against the wellbore during drilling. This is commonly referred to as the "smear effect." As discussed in the '913 paper, the wellbore strengthening occurred over time as the drilling with casing continued. In the strengthening period, lost circulation to the formation still occurred. Any acceleration of the wellbore strengthening effect of drilling with casing would be valuable for the reduced amount of expensive mud lost to the formation, time spent on slower drilling in order to wait for the effect, and the ability to increase mud weight for safety ahead of drilling through higher pressure formations that could produce dangerous kicks of hydrocarbons, without setting a casing/liner separating the two formations.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIG. 1 is a wellbore schematic in accordance with one embodiment.

DETAILED DESCRIPTION

For clarity in the following description, "drilling with casing" is when the tubular used to control the drill bit from the surface is a string of casing or liners instead of conventional drill pipe. The distinction between a casing and a liner refers to whether the tubular string extends to the surface (casing) or to an intermediate point in the well (liner). Because there are no physical differences between the tubular joints themselves, the term casing or liner may be used interchangeably in the context of the present disclosure.

In FIG. 1, a wellbore schematic in accordance with one embodiment is shown. A bottom hole assembly (BHA) 20 is conveyed by a casing string 1. The BHA 20 includes various drilling components, such as a drill bit, an underreamer, and a mud motor. The drilling rig is not shown, but includes at least one mud pump 5 for pumping drilling fluid through the casing string 1. A mechanism for sealing an annulus between the casing string 1 and surface casing 10 is provided at or near the surface, such as a rotating head 6. An outflow conduit 2 is provided for drilling fluid to exit the annulus between the surface casing 10 and the casing string 1. A choke 7 is provided in the path of the outflow conduit 2 to control back pressure. A flow meter 8 monitors the volume of drilling fluid flowing through the outflow conduit 2.

In the wellbore schematic of FIG. 1, the BHA 20 and a portion of the casing string 1 have already drilled an open hole section 11 through a loss zone 15. In such a loss zone, drilling fluid is lost to the open hole section 11 where the wellbore strength is low and the formation is permeable. In the prior art, loss zones may be managed by pumping extra solids known as lost circulation material with the drilling fluid, reducing the density ("mud weight") of the drilling fluid to reduce hydrostatic pressure, and/or pumping drilling fluid at increasing volumes to make up for the lost circulation so that cuttings from drilling may still be carried to the surface and hydrostatic pressure is maintained in the annulus. Decreasing the mud weight may not be an option if a high pressure zone 16 exists below the loss zone 15. The high pressure zone 16 may be the hydrocarbons targeted by the drilling operation. Penetrating the high pressure zone 16 with low mud weight risks a blowout. At the same time, losing drilling fluid to the loss zone 15 risks a blowout if insufficient drilling fluid is maintained in the annulus between the casing string 1 and the surface casing 10 to provide hydrostatic pressure greater than the pressure of the high pressure zone 16. If the loss zone 15 cannot be managed, setting a liner across the loss zone 15 may be necessary before drilling into the high pressure zone 16, which is an operation that costs significant time and money.

As a specific example to illustrate a method in accordance with an embodiment of the invention, the loss zone 15 may initially support a 12 pound per gallon (ppg) drilling fluid. To safely drill into the high pressure zone 16, a 14 ppg drilling fluid may be needed to provide sufficient hydrostatic pressure to prevent a blowout. The goal for wellbore strengthening in the loss zone 15 would be to strengthen the wellbore in the area of the loss zone 15 to not leak drilling fluid when exposed to the hydrostatic pressure of the 14 ppg drilling fluid.

To achieve this wellbore strengthening in an accelerated manner, the loss zone 15 may be hydraulically fractured and mechanically repaired incrementally in accordance with an embodiment of the invention. The process may begin by drilling through the loss zone 15 at a first rate of penetration (ROP) with an appropriately weighted drilling fluid to minimize lost circulation, for example 12 ppg drilling fluid. After a portion of the casing string 1 is past the loss zone 15, the ROP may be reduced by adjusting drilling parameters such as the rotation rate and weight on bit (WOB). The wellbore strengthening benefits are thought to begin after about 60 to 90 feet of casing, or 2 to 3 joints, have past the loss zone 15. When the ROP is reduced, the flow rate through the mud pump 5 may also be reduced to a rate sufficient to provide hole cleaning at the reduced ROP.

After the casing string 1 is at the desired position, hydraulic fracturing is achieved by creating a pressure vessel between the mud pump 5, the rotating head 6, and the choke 7 in the outflow conduit 2. While drilling at the reduced ROP continues, the rotating head 6 seals off the annulus between the surface casing 10 and the casing string 10. The choke 7 is used to provide back pressure as the mud pump 5 forces drilling fluid into the casing string. A mud pump is typically a piston pump, which allows for a controlled volume of fluid to be pumped with each stroke without being affected by back pressure. Balancing the choke 7 and the flow rate through mud pump 5 allows for pressure in the loss zone 15 to be gradually increased until microfractures are created, which causes drilling fluid to be lost. The loss of drilling fluid may be detected by the difference between the volume exiting the mud pump 5 and the volume measured by flow meter 8. After detecting the loss of drilling fluid, the additional pressure is maintained as the reduced ROP drilling continues, which creates drill cuttings for the casing string 1 to mechanically force into and plug the microfractures in the loss zone 15. The reduced flow rate from the mud pump 5 allows for the drill cuttings to be ground into smaller particles and to flow upward at a reduced velocity so that an increased amount of the drill cuttings flow into the microfractures. The sealing of the microfractures can be detected from the surface by observing a balance between the volume exiting the mud pump 5 and the volume measured by flow meter 8. The process of microfracturing and then repairing the wellbore in loss zone 15 can be incrementally repeated with increasing pressure while continuing to drill at the reduced ROP. During this process, solids of a desired particle size distribution corresponding to the particular formation properties of the loss zone 15 may be introduced into the drilling fluid to aid the sealing of the microfractures. Each successive microfracture and sealing gradually strengthens the wellbore to enable the wellbore in the loss zone 15 to support a higher ppg drilling fluid without leakage. An equivalent mud weight may be calculated from the dynamic pressure from the combination of the mud pump 5 and the choke 7. After the loss zone 15 supports a dynamic pressure corresponding to the desired mud weight, a formation integrity test and/or a leak off test may be carried out to confirm the wellbore strength in the loss zone 15 before continuing drilling into the high pressure zone 16. With the wellbore strength confirmed from the test(s), the mud weight may be increased corresponding to the pressure expected to be encountered in the high pressure zone 16.

The disclosed method of strengthening a wellbore is particularly useful for development drilling after one or more exploratory wells have been drilled nearby to study the composition and pressures of the formations at various depths. If the composition of the loss zone 15 is known, the particle size distribution of solids in the drilling fluid may be selected according to the expected gaps between microfractures. With the above disclosed methods and apparatus and formation data, experimentation with mud weights, particle size distributions, pressures, and other parameters of drilling with casing may be carried out to optimize the strength of the wellbore and the rate at which the strengthening occurs.

In one embodiment, the incremental microfracturing and sealing to strengthen the wellbore may be carried out in an automated manner with minimal human interaction from the surface. A computer controller could receive signals corresponding to the flow rate from the mud pump 5, pressure against the rotating head 6, and the flow rate through the flow meter 8. In response to those signals, the computer controller could send signals to actuate the choke 7, adjust properties of the drilling fluid, change the flow rate through the mud pump 5, adjust WOB, adjust rotation of the casing string 1, or various other parameters. A computer controller would have the benefit of more quickly determining the volume and pressure balance during the incremental microfracturing and sealing of the wellbore during the wellbore strengthening process. If more complete automation is desired, the various drilling parameters could be input into a Kalman filtering logarithm associated with the computer controller to detect deviations in the incremental wellbore strengthening process.

In another embodiment, drill cuttings may be recirculated back into the wellbore to aid wellbore strengthening. Devices known as shale shakers are commonly used in drilling to remove drill cuttings from the drilling fluid to maintain desired fluid properties. Modern shale shakers are able to sort solids in the drilling fluid according to size by using multiple screens of varying mesh sizes. One known use of this sorting ability is to remove valuable solids that were previously added to the drilling fluid, such as lost circulation material (LCM). Drill cuttings arrive at the shale shakers in a wide range of particle sizes, from visible clumps to less than 50 microns. The drill cuttings consist of the same material of the wellbore that the present disclosure intends to strengthen, and can aid further strengthening by refining the particle size according to the properties of the zone being strengthened (e.g., loss zone 15).

To refine the drill cuttings, the shale shaker(s) may be set up to direct solids of a selected size to a secondary device configured to make the solids into smaller particles of a size selected according to the formation properties. For example, from prior wells, the residual porosity of the loss zone 15 may show that particles of around 75 to about 100 microns would fill the remaining gaps in the loss zone 15. The shale shaker may be arranged to include a mesh screen to filter out the drill cuttings that are greater than about 100 microns, and may further include a mesh screen that filters out drill cuttings greater than about 250 microns so that only solids in a desired range of 100-250 microns are passed from the shale shaker to the secondary device for refinement of the solids into smaller particles. Drilling fluid may be added to the selected solids to act as a carrier fluid to the secondary device. The secondary device may be, for example, a rod mill or ball mill similar to those used in mining operations. Rod mills use a rotating barrel of rods to crush larger particles. The resulting particle sizes are controlled by adjusting the flow rate through the rod mill. More than one rod mill may be used to process the drilling fluid coming from the shale shaker.

Following refinement by the secondary device(s), the drill cuttings of the desired size range are returned to the drilling fluid and pumped back into the wellbore by the mud pump. At least some of the returned drill cuttings will flow into the microfractures in the loss zone 15 to fill remaining gaps and strengthen the wellbore. The use of drill cuttings rather than LCM may be more effective in strengthening the wellbore because the drill cuttings are naturally more compatible with the formation by virtue of being the same material. LCM is commonly fibrous or spongy materials, such as crushed nut hulls, which does not have the same material strength of the formation, which may be, for example, sandstone or limestone. Bringing LCM comprised of crushed stone similar to the formation and of the desired particle size may be an alternative to using drill cuttings, but requires additional expense and logistics.

Although this detailed description has shown and described illustrative embodiments of the invention, this description contemplates a wide range of modifications, changes, and substitutions. In some instances, one may employ some features of the present invention without a corresponding use of the other features. Accordingly, it is appropriate that readers should construe the appended claims broadly, and in a manner consistent with the scope of the invention.

What is claimed is:

1. A method of strengthening a wellbore, comprising:

drilling through a formation using a drill bit conveyed by a tubular string having an outer diameter at least 70 percent of the wellbore being drilled, wherein the formation is drilled at a first rate of penetration (ROP) while pumping drilling fluid at a first flow rate;

after drilling through the formation so the tubular string extends beyond the formation, reducing the ROP to a second ROP, reducing the flow rate to a second flow rate, and increasing a pressure in the wellbore until drilling fluid begins to leak into the formation;

while maintaining the increased pressure in the wellbore, monitoring the volume of drilling fluid lost to the formation until the rate at which the drilling fluid loss occurs is reduced; and repeating the increasing of pressure, leaking of drilling fluid into the formation, and monitoring the volume of drilling fluid lost to the formation until the rate at which the drilling fluid loss occurs is reduced until a selected wellbore strength is achieved.

2. The method of claim 1, further comprising:

filtering drill cuttings of a selected size range from the drilling fluid;

pumping the filtered drill cuttings back into the wellbore.

3. The method of claim 2, further comprising:

refining the filtered drill cuttings into smaller particles before pumping the filtered drill cuttings back into the wellbore.

4. The method of claim 2, wherein the selected size of the refined drill cuttings is selected according to formation properties.

5. The method of claim 1, wherein the selected wellbore strength of the formation is sufficient to resist the pressure exerted on the formation by drilling fluid selected for drilling into a high pressure zone located below the formation.

6. The method of claim 5, further comprising:

drilling into the high pressure zone without cementing a liner in the wellbore between the formation and the high pressure zone.

7. A method of drilling a wellbore, comprising:

determining an approximate depth of a loss zone based on well data from a prior well drilled in a vicinity of the wellbore to be drilled;

drilling down to the loss zone using a drill bit conveyed by a tubular string having an outer diameter at least 70 percent of the wellbore being drilled, wherein the loss zone is drilled at a first rate of penetration (ROP) while pumping drilling fluid at a first flow rate;

after drilling through the loss zone so the tubular string extends beyond the loss zone, reducing the ROP to a second ROP, reducing the flow rate to a second flow rate, and increasing a pressure in the wellbore until drilling fluid begins to leak into the loss zone;

while maintaining the increased pressure in the wellbore, monitoring the volume of drilling fluid lost to the loss zone until the rate at which the drilling fluid loss occurs is reduced; and repeating the increasing of pressure, leaking of drilling fluid into the loss zone, and monitoring the volume of drilling fluid lost to the loss zone until the rate at which the drilling fluid loss occurs is reduced until a selected wellbore strength is achieved.

8. The method of claim 7, wherein the selected wellbore strength of the loss zone is sufficient to resist the pressure exerted on the loss zone by drilling fluid selected for drilling into a high pressure zone located below the loss zone.

9. The method of claim 8, further comprising:

drilling into the high pressure zone without cementing a liner in the wellbore through the loss zone.

10. The method of claim 7, further comprising:

filtering drill cuttings of a selected size range from the drilling fluid;

pumping the filtered drill cuttings back into the wellbore.

11. The method of claim 10, further comprising:

refining the filtered drill cuttings into smaller particles before pumping the filtered drill cuttings back into the wellbore.

12. The method of claim 10, wherein the selected size of the refined drill cuttings is selected according to the properties of the formation properties.

* * * * *